US005421141A

United States Patent [19]

Gordon

[11] Patent Number: 5,421,141

[45] Date of Patent: Jun. 6, 1995

[54] STRETCH WRAPPING MACHINES WITH SUPPORT BEARING ARRANGEMENTS

[75] Inventor: Yoram Gordon, Louisville, Ky.

[73] Assignee: Lantech, Inc., Louisville, Ky.

[21] Appl. No.: 972,848

[22] Filed: Nov. 6, 1992

[51] Int. Cl.[6] ..... B65B 11/02; B65B 11/04; B65B 53/00

[52] U.S. Cl. ..... 53/556; 53/587; 53/588

[58] Field of Search ..... 384/37, 42; 53/210, 53/211, 556, 587, 588

[56] References Cited

U.S. PATENT DOCUMENTS

| | | | |
|---|---|---|---|
| 709,938 | 8/1902 | Hendrick . | |
| 2,503,028 | 4/1950 | Cook . | |
| 3,003,297 | 10/1961 | Broadhead et al. | 53/588 |
| 3,068,552 | 12/1962 | Williams et al. . | |
| 3,814,488 | 6/1974 | Rood . | |
| 4,109,445 | 8/1978 | Shulman | 53/588 X |
| 4,110,957 | 9/1978 | Lancaster et al. | 53/588 X |
| 4,117,650 | 10/1978 | Ito et al. . | |
| 4,468,915 | 9/1984 | Parry | 53/211 X |
| 4,549,388 | 10/1985 | Lancaster | 53/588 X |
| 4,619,193 | 10/1986 | Crew | 53/588 X |
| 4,738,081 | 4/1988 | Tisma | 384/42 X |
| 4,917,021 | 4/1990 | Murphy | 384/42 X |
| 4,940,339 | 7/1990 | Amano | 384/42 X |
| 4,941,758 | 7/1990 | Osawa | 384/42 X |
| 4,981,373 | 1/1991 | Bando . | |
| 5,110,223 | 5/1992 | Koch et al. . | |
| 5,212,933 | 5/1993 | Cere | 53/588 X |

*Primary Examiner*—Linda B. Johnson
*Attorney, Agent, or Firm*—Finnegan, Henderson, Farabow, Garrett & Dunner

[57] ABSTRACT

A stretch wrapping machine includes a web dispenser and a rotatable support for providing relative rotation between the web dispenser and load to wrap a web of packaging material around the load. Cooperating bearing members engage each other for supporting the rotatable support and permitting the rotation of the rotatable support. One of the bearing members is mounted on the rotatable support and the other bearing member is mounted on the fixed support. One of the bearing members includes a track of resilient material and the other bearing member includes a roller surface which rolls along the track of resilient material.

20 Claims, 5 Drawing Sheets

STRETCH WRAPPING MACHINES WITH SUPPORT BEARING ARRANGEMENTS

BACKGROUND OF THE INVENTION

1. Field of the Invention

The present invention relates to stretch wrapping machines with support bearing arrangements.

2. Description of the Related Art

Stretch wrapping machines wrap a web of packaging material around a load by providing relative rotation between a web dispenser and the load. These wrapping machines may be structured in various arrangements to accommodate particular applications. U.S. Pat. Nos. 3,793,798, 4,317,322, 4,302,920, 4,109,445, 4,722,170, 4,858,415, 4,845,920 and 4,866,909 are incorporated herein by reference to illustrate a number of these arrangements.

In U.S. Pat. Nos. 3,793,798, 4,109,445 and 4,722,170, a web dispenser is supported on an arm which extends radially outward and downward from a vertical axis. The arm moves the dispenser in an orbital path about the vertical axis to wrap the load. In U.S. Pat. Nos. 4,845,920 and 4,858,415, the load is placed on a rotatable turntable. As the turntable rotates about a vertical axis, the load is wrapped with a web which is dispensed from a dispenser. In U.S. Pat. No. 4,866,909, the wrapping machine has a rotatable annular frame which carries the web dispenser in an orbital path about a horizontal axis to wrap a load.

In each of these arrangements, either the web dispenser or the load support is a relatively heavy inertial body which travels at substantial velocities. An example of an existing support system for a rotating unit includes a 37 inch diameter slew ring bearing. Such a bearing is constructed from two unhardened low carbon steel rings with machined raceways, and two point contact balls in a single row. The bearing requires continuous lubrication, but has no seals to contain grease or other lubricants. Uneven wear can occur in such a bearing due to unbalanced loading and nonlevel floors. Using a higher precision bearing with ground and hardened raceways and seals could overcome such disadvantages but would also increase the cost significantly. Also, the need for a rigid and highly precise base adds expense.

Another existing support system includes a metal raceway and rollers. The rollers are coated with resilient material such as polyurethane. Such an arrangement has the advantage of being substantially less expensive than a precision bearing. This eliminates the need for special tolerances and lubrication. However, after a period of use, some stretch wrapping machines with this bearing arrangement failed because the polyurethane coating on the rollers separated from the roller surface or otherwise ceased to produce the resilient effect that was necessary for such a bearing.

SUMMARY OF THE INVENTION

An object of the invention is to provide a stretch wrapping machine which is relatively simple in construction, reliable and durable, and low in maintenance.

Another object of the invention is to provide a stretch wrapping machine which has a significantly increased capacity during static and dynamic loading, and an increased ability to forgiveably absorb impact shocks and recover completely from the impact.

Another object of the invention is to provide a stretch wrapping machine which does not have a need for bearing lubrication or problems with lubrication containment.

Another object of the invention is to provide a stretch wrapping machine having a support system with bearings which are not adversely affected by environmental conditions and contaminants such as dirt and water.

Another object of the invention is to provide a stretch wrapping machine having a sufficiently large support system for oversized loads to prevent deflection of overhung members.

Another object of the invention is to provide a stretch wrapping machine having a support system which does not wear unevenly due to unbalanced loading, nonlevel floors, nonrigid mounts, sudden impact loads, or overloading.

Another object of the invention to provide a stretch wrapping machine with a bearing arrangement which is resistant to corrosion, mud and other effects of washdown conditions.

Another object of the present invention to provide a stretch wrapping machine with a bearing arrangement which dissipates internal heat that develops during operation.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises an apparatus for stretch wrapping a load with a web of packaging material. The apparatus includes a fixed support, a web dispenser, and a rotatable support for providing relative rotation between the web dispenser and the load to wrap the web of packaging material around the load. It also includes cooperating bearing members which engage each other for supporting the rotatable support and permitting the rotation of the rotatable support. One of the bearing members is mounted on a rotatable support and the other bearing member is mounted on the fixed support. One of the bearing members includes a track of resilient material and the other bearing member includes a roller surface which rolls along the track of resilient material.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate an embodiment of the invention and, together with the description, serve to explain the principles of the invention. In the drawings.

DESCRIPTION OF THE PREFERRED EMBODIMENT

Figure 1:
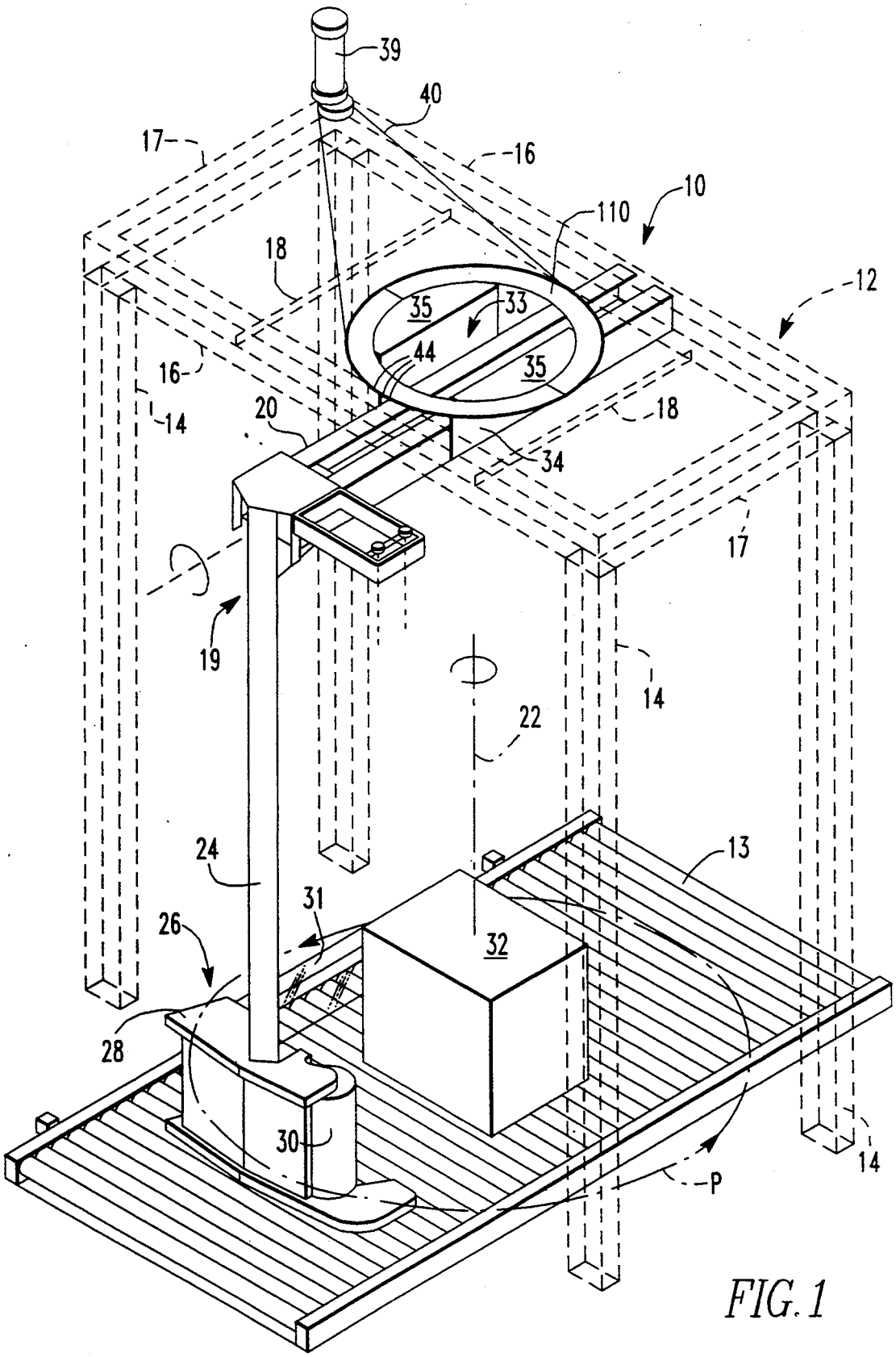
FIG. 1 is a perspective view showing an exemplary embodiment of a stretch wrapping machine incorporating the present invention.

Reference will now be made in detail to the present preferred embodiments of the invention, examples of which are illustrated in the accompanying drawings. Wherever possible, the same reference characters will be used throughout the drawings to refer to the same or like parts.

According to the present invention, there is provided an apparatus for stretch wrapping a load with a web of packaging material. The apparatus includes a fixed support, a web dispenser, and a rotatable support for providing relative rotation between the web dispenser and the load to wrap the web packaging material around the load.

In FIG. 1, the apparatus for stretch wrapping a load with a web of packaging material is embodied in a stretch wrapping machine 10. The fixed support is embodied as a fixed frame 12. Frame 12 includes standards 14, side members 16, end members 17 and spaced intermediate supporting beams 18 fixed to side members 16. The fixed support can be embodied in a variety of other ways and is not limited to a frame structure as shown in the drawings.

As shown in FIG. 1, the web dispenser is embodied as a dispenser 26 which supports a supply roll of packaging material 30, such as a stretch wrap film web 31. Dispenser 26 may include a brake for restraining and stretching the film web 31 as it is wrapped on the load 32 supported by conveyor 13. Dispenser 26 may include a roll carriage 28 with interconnected pre-stretch rollers which rotate at different speeds to stretch the film web 31 before dispensing it on the load 32 such as that shown in U.S. Pat. No. 4,845,920. It may also include a dancer bar or other arrangement to sense and regulate tension on the film web 31.

As shown in FIG. 1, the rotatable support includes an arm 19 comprising a radially extending horizontal beam 20 and a vertically extending column 24 which respectively extend radially outward and downward from a central vertical axis 22.

Figure 2:
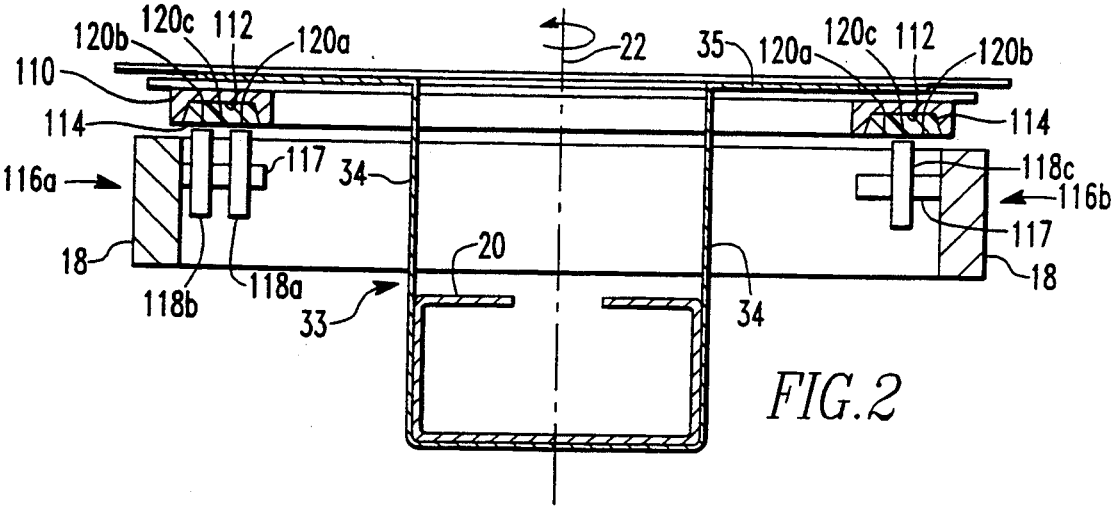
FIG. 2 is a fragmentary cross section illustrating the support of rotatable components in the machine shown in FIG. 1.

As shown in FIG. 2, beam 20 is supported from the frame 12 by an upstanding bracket 33 having a pair of walls 34 joining with outwardly radiating flanges 35. As shown in FIG. 1, a drive motor 39 is mounted on the top of the frame 12 and is coupled by a drive belt 40 to the outer radial surface of race 110 to rotatably drive arm 19 and dispenser 26 in an orbital path P concentric with the axis 22.

It is possible to provide an arrangement that permits the elevation of dispenser 26 to be adjusted on the column 24 during such relative movement of the dispenser 26 and the load 32, so that the film web 31 will be applied to the full height of the load 32 in generally spiral fashion. This operation is described in more detail in U.S. Pat. Nos. 3,793,798; 4,109,445; and 4,722,170. It is also possible to provide other features such as the sensing and stopping features described in more detail in U.S. patent application Ser. No. 07/943,235 which is incorporated herein by reference.

According to the present invention, there are provided cooperating bearing members which engage each other for supporting the rotatable support and permitting rotation of the rotatable support. One of the bearing members is mounted on a rotatable support and the other bearing member is mounted on the fixed support. One of the bearing members includes a track of resilient material and the other bearing member includes a roller surface which rolls along the track of resilient material.

As shown in FIG. 2, one of the bearing members is a circular race 110 formed from a ring of steel. Race 110 includes a concave portion 112 on its lower axial surface. The concave portion 112 defines an annular groove and is filled with resilient polyurethane through a molding process or another assembly technique. The concave portion 112 effectively has annular walls for containing the resilient material. The polyurethane forms a circular track 114 of resilient material along the lower axial surface of race 110. The track of resilient material may take other forms as well. For example, the resilient material may completely cover the lower axial surface of a support plate on the stretch wrapping machine.

As shown in FIG. 2, the roller surface includes a plurality of roller units 116. Roller units 116 preferably include shafts 117 and rollers 118 which are mounted on shafts 117. It is preferable that the rollers are cylindrical and made of steel or another metal. However, other roller surfaces and materials are also within the scope of the claimed invention.

It is preferable that the plurality of roller units are spaced around the track of resilient material so that one of the roller units engages a portion of the track of resilient material at a location different from the portion of the track engaged by another one of the roller units. This is accomplished in the preferred embodiment by using two rollers **118*a* and 118*b* in roller unit 116*a* to engage track 114 at outer portions 120*a* and 120*b*, while using roller 118*c* of roller unit 116*b* to engage a central portion 120*c* of track 114**.

While the illustrated embodiment shows race 110 riding in a circular motion over a plurality of metal rollers that are supported with shafts to a fixed ring, it is within the scope of the claimed invention to move the metal rollers in a circular motion over a fixed race of polyurethane. In either case, the total number of rollers and rollers on each shaft can be progressively and easily changed to accommodate different thrust loadings.

The use of a bearing having a plastic material which engages a metal material prevents excessive wear and noise. The use of a race of resilient material along which rollers roll has been found to increase the capacity of loading the stretch wrapping system statically and dynamically, and also improve the absorption of impact shocks. It also has been found to dissipate the internal heat that develops in the resilient material without the help of a lubricant.

The resilient material is preferably a resilient synthetic polymeric material. The resilient material also is preferably an elastomer such as acrylic elastomers, butyl rubber, chlorosulfonated polyethylene, ethylene-proylene rubber, fluorinated elastomers, neoprene, nitrile rubber, polybutadiene, polyethers, polyisoprene, polypentenamers, styrene-butadiene rubber and thermoplastic elastomers described in more detail in Kirk-Othmer Concise Encyclopedia of Chemical Technology, published by John Wiley & Sons, Inc. and incorporated herein by reference. The resilient material can include a blend of such materials.

A satisfactory resilient material for this application is one that has the ability to recover after loading, and which can quickly bounce or spring back into shape after being compressed, bent or stretched. In the preferred embodiment, the resilient material includes a material known as urethane rubber or polyurethane. An acceptable polyurethane is made by Custom Urethane Elastomers, Inc. (CUE) of Pennsylvania, namely product number PO 652 having a durometer of 93 Shore A. The resilient material can include other polymers such as rubber, silicone, acrylic, polyethylene, and UHMW.

The resilient material preferably has a surface hardness or durometer which provides a tough uniform rolling surface at a high load without deep penetration of the rollers. It is preferable that the resilient material has a durometer in the range of 0 to 65 Shore D. It is more preferable that the resilient material has a durometer in the range of 60 Shore A to 95 Shore A, and even more preferably in the range of 90 to 95 Shore A. The resilient material preferably is soft enough to provide a cushion which absorbs impacts and unbalanced loading and is sufficiently forgiving of imprecision caused by manufacturing tolerances and uneven floors.

The resilient material preferably resists abrasion from shear and scuffing forces without any added lubrication. The resilient material preferably has a fast and full recovery after being compressed in an overloading condition. It also preferably has a high pressure capacity.

The resilient material preferably resists solvents used in wash-down applications. The resilient material preferably is moldable into any shape in a simple and inexpensive process such as gravity molding. The resilient material preferably maintains excellent bonding strength to metal surfaces.

The resilient material preferably is compressible under overloading conditions such as an impact load or a load in which a fork truck rolls over the turntable of the stretch wrapping machine such that the dynamic capacity of the machine is exceeded and the resilient material subsequently recovers without permanent deformation or deflection. In one application of the resilient material in a stretch wrapping turntable bearing it is preferable that the resilient material recovers without permanent deflection after supporting a static load of 15,000 pounds or a dynamic load of 5,000 pounds.

The resilient material preferably has forgiveness which accommodates uneven loading situations such as unbalanced loads, uneven floors and standard tolerance buildups in manufacturing. The resilient material preferably tolerates high load capacity and speed of operation, and allows heat buildup dissipation which prevents adhesive delamination.

Figure 7:
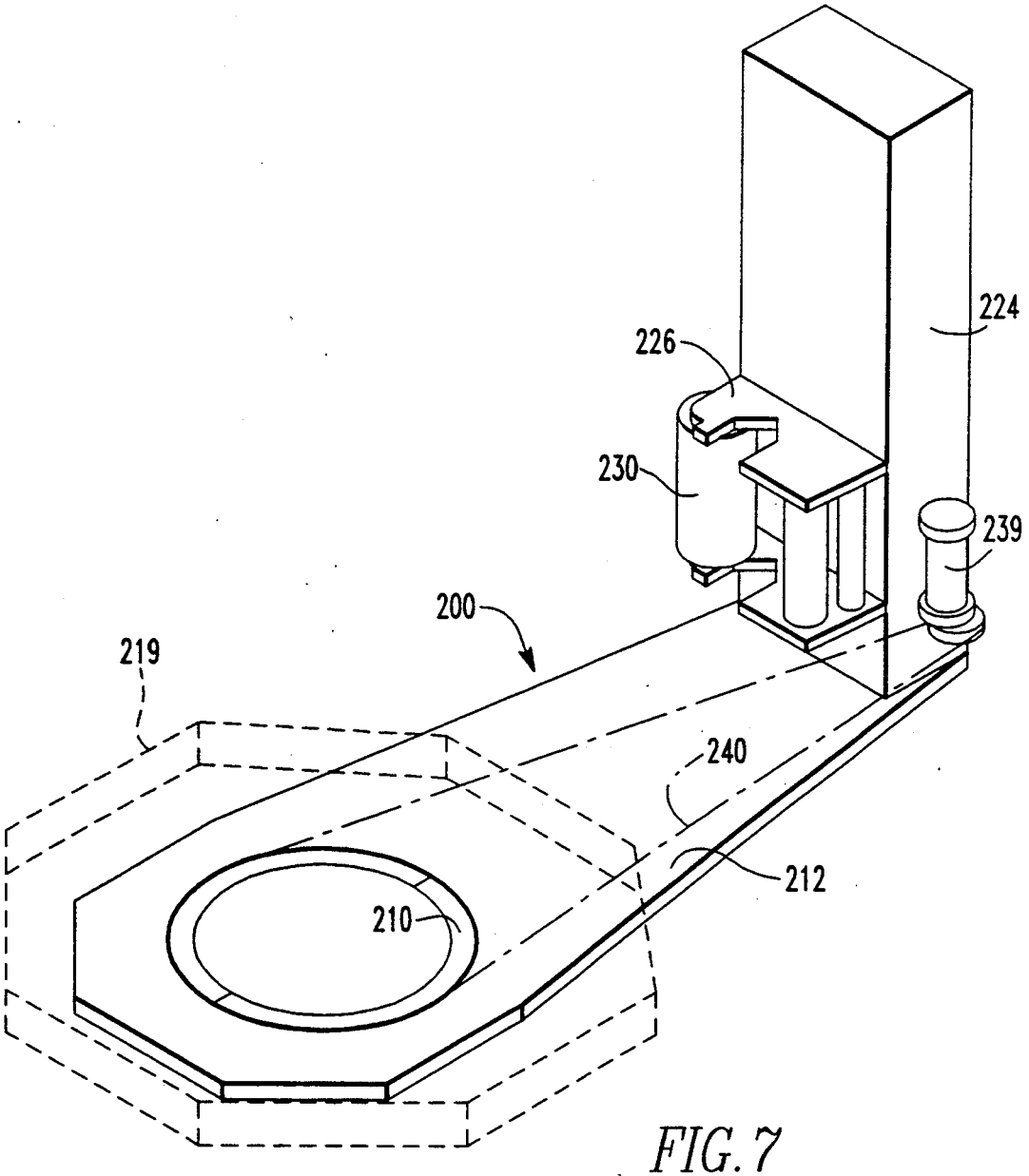
FIG. 7 is a schematic perspective view showing an alternative embodiment of a stretch wrapping machine incorporating the present invention.

In FIG. 7 of the drawings, an alternative embodiment of the present invention is illustrated as a stretch wrapping machine 200. The wrapping machine 200 in FIG. 7 is of a type similar to those disclosed in U.S. Pat. Nos. 4,845,920 and 4,858,415.

Figure 4:
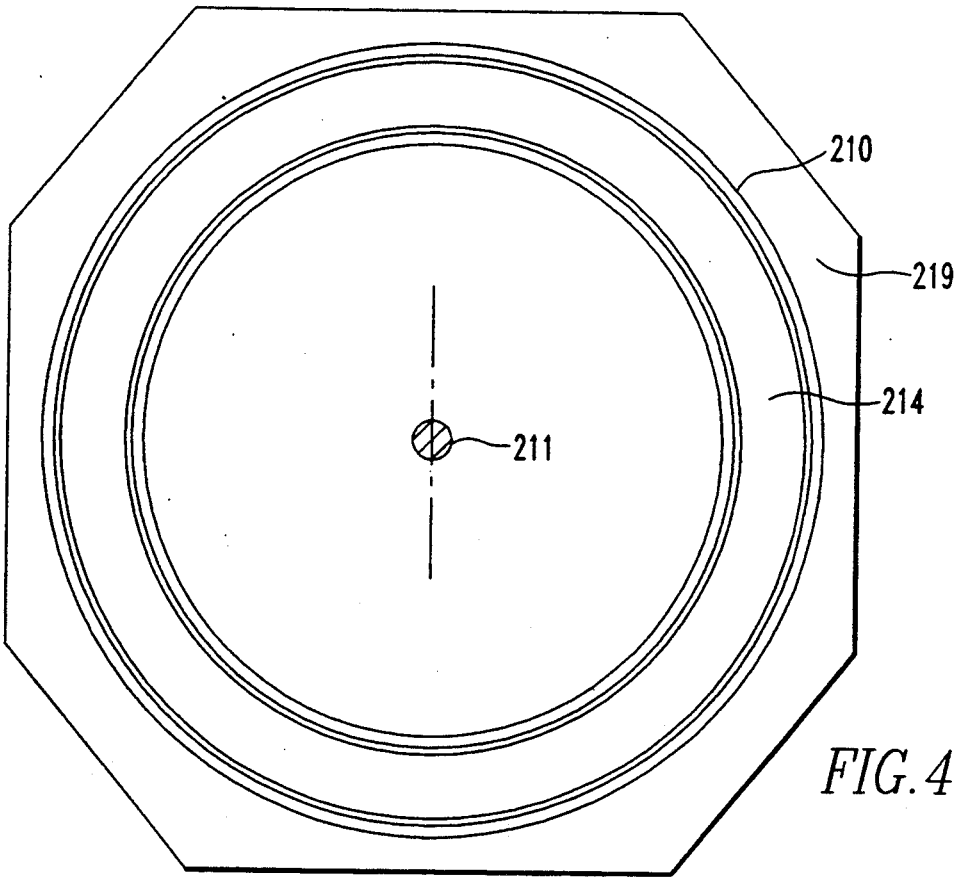
FIG. 4 is a bottom plan view as seen on plane 4—4 of FIG. 3.
Figure 3:
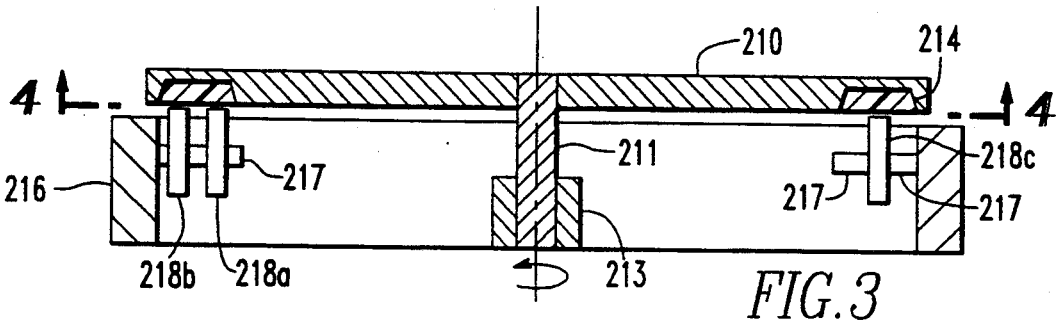
FIG. 3 is a fragmentary cross section illustrating the support of rotatable components in the machine shown in FIG. 7.

In this embodiment, the rotatable support includes a turntable 219 for rotation relative to a fixed support such as a frame 212 on which a dispenser 226 is mounted. The arrangement may employ a bearing arrangement similar to that illustrated in FIG. 2. As shown in FIGS. 3 and 4, the bearing arrangement for the turntable includes a fixed ring 216 which supports shafts 217 and rollers 218.

Race 210 is connected to the underside of turntable 219 as shown in FIG. 4. Race 210 and turntable 219 rotate so that rollers 218 roll along track 214. Shaft 211 is connected to turntable 219 and rides in roller bearing 213 to maintain the radial alignment of turntable 219 during rotation. The wrapping material dispenser 226 in this embodiment is supported on a vertical column 224 which is part of frame 212. In machine 200, the turntable 219 supports a load to be wrapped and is driven in rotation by motor 239 and belt 240 relative to the dispenser 226.

Figure 8:
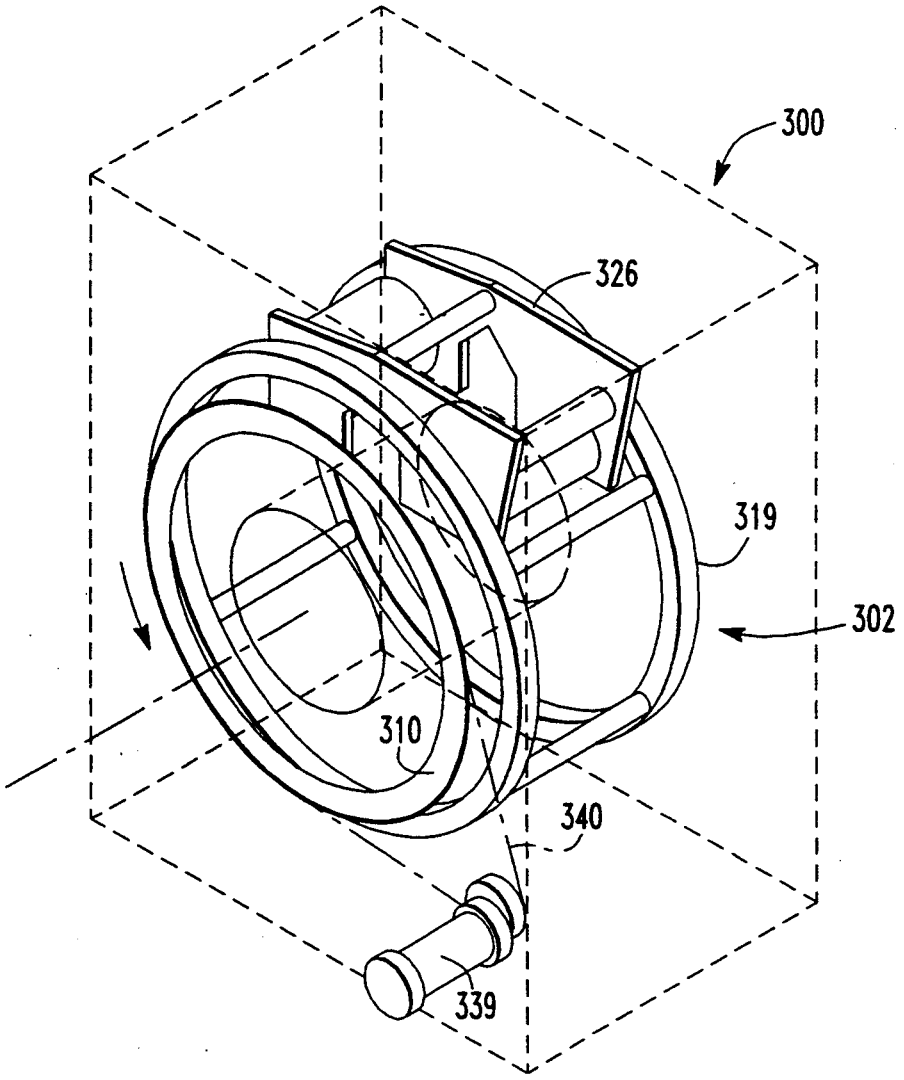
FIG. 8 is a schematic perspective view illustrating another alternative embodiment of a stretch wrapping machine incorporating the present invention.

In FIG. 8, a further embodiment of the present invention is represented by a wrapping machine 300. The machine 300 is of a type disclosed in U.S. Pat. No. 4,866,909.

In this embodiment, the fixed support includes a fixed frame 302 with a bearing ring, and the rotatable support includes a annular rotatable frame 319 with a cooperating bearing ring 310. Rotatable frame 319 supports a wrapping material dispenser 326 for rotation about a central horizontal axis 322.

Figure 6:
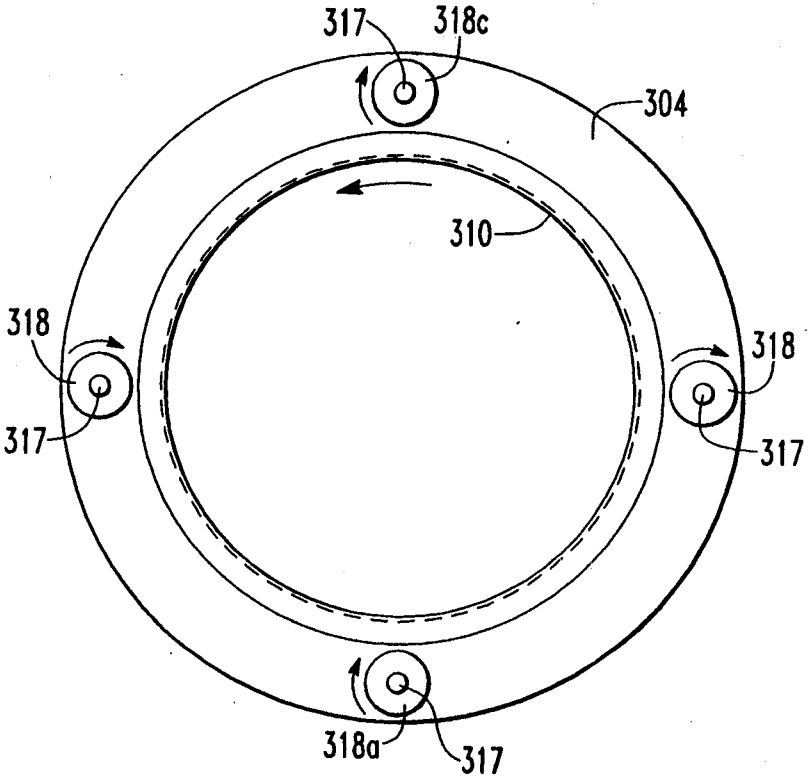
FIG. 6 is an end view of FIG. 5.
Figure 5:
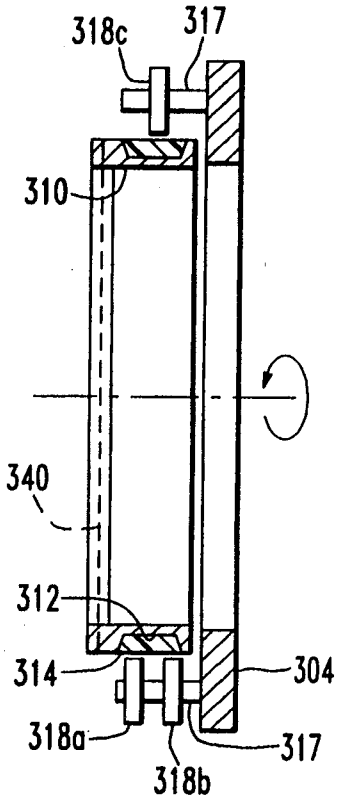
FIG. 5 is a fragmentary cross section illustrating the support of rotatable components in the machine shown in FIG. 8.

A preferred bearing arrangement for the embodiment shown in FIG. 8 is illustrated in FIGS. 5 and 6. Race 310 includes a concave portion 312 in its outer radial surface. The concave portion includes a track 314 of resilient polyurethane. Rollers 318 are mounted on shafts 317 which are attached to a fixed ring 304 which is part of frame 302. A product to be wrapped is fed centrally along the axis 322 and retained against rotation by a conveyor (not shown) such as that illustrated in U.S. Pat. No. 4,317,322. Orbital movement of the dispenser 326 about the interior of the frame 302 results in the wrapping operation previously described, but on a horizontal axis. Race 310 is driven by belt 340 and motor 339.

In each of the embodiments shown, the circumference and diameter of the track is greater than the circumference and diameter of the roller surface which engages the track so that the roller surface has a shorter length and greater curvature than the track.

It will be apparent to those skilled in the art that various modifications and variations can be made in the wrapping machine of the present invention without departing from the scope or spirit of the invention.

Other embodiments of the invention will be apparent to those skilled in the art from consideration of the specification and practice of the invention disclosed herein. For example, the alternative embodiments of the present invention may be constructed by modifying known stretch wrapping machines such as that shown in U.S. Pat. No. 4,587,796 which is incorporated herein by reference. It is intended that the specification and examples be considered as exemplary only, with a true scope and spirit of the invention being indicated by the following claims and their equivalents.

What is claimed is:

1. An apparatus for stretch wrapping a load with a web of packaging material comprising:

a fixed support;

a web dispenser;

a rotatable support for providing relative rotation between the web dispenser and the load to wrap the web of packaging material around the load;

cooperating bearing members which engage each other for supporting the rotatable support and permitting the rotation of the rotatable support, one of the bearing members being mounted on the rotatable support and the other bearing member being mounted on the fixed support, one of the bearing members including a track of resilient material and the other bearing member including a roller surface which rolls along the track of resilient material, the roller surface being of less resilient material than the track and of shorter length than the track.

2. The apparatus of claim 1, wherein the bearing member with the track of resilient material is mounted on the rotatable support and the bearing member with the roller surface is mounted on the fixed support.

3. The apparatus of claim 1, wherein the track of resilient material has a ring shape with an axial surface for engaging the roller surface.

4. The apparatus of claim 1, wherein the track of resilient material has a ring shape with a radial surface for engaging the roller surface.

5. The apparatus of claim 1 wherein the bearing member with the resilient material includes walls for containing the resilient material.

6. The apparatus of claim 1, wherein the rotatable support supports the load.

7. The apparatus of claim 1, wherein the rotatable support supports the web dispenser.

8. The apparatus of claim 1, wherein the resilient material includes a resilient synthetic polymeric material.

9. The apparatus of claim 1, wherein the resilient material includes an elastomer.

10. The apparatus of claim 1, wherein the resilient material includes urethane rubber.

11. The apparatus of claim 1, wherein the resilient material has a durometer in the range of 0 to 65 Shore D.

12. The apparatus of claim 1, wherein the resilient material has a durometer in the range of 60 Shore A to 95 Shore A.

13. The apparatus of claim 1, wherein the resilient material has a durometer in the range of 90 to 95 Shore A.

14. The apparatus of claim 1, wherein the resilient material is capable of supporting a static load of 15,000 pounds and recovering without permanent deflection.

15. The apparatus of claim 1, wherein the resilient material is capable of supporting a static load of 5,000 pounds and recovering without permanent deflection.

16. The apparatus of claim 1, wherein the roller surface includes a plurality of roller units spaced around the track of resilient material.

17. The apparatus of claim 1, wherein the roller surface includes a plurality of roller units spaced around the track of resilient material, and one of the roller units engages a portion of the track of resilient material at a location different from the portion of the track engaged by another one of the roller units.

18. The apparatus of claim 1, wherein the roller surface includes cylindrical rollers.

19. The apparatus of claim 1, wherein the roller surface is metal.

20. The apparatus of claim 1, wherein the resilient material is plastic and the roller surface is metal.

* * * * *